US005102288A

United States Patent [19]

Kawasaka

[11] Patent Number: 5,102,288

[45] Date of Patent: Apr. 7, 1992

[54] WORK TABLE FOR PATTERN MATCHING

[75] Inventor: Shozo Kawasaka, Osaka, Japan

[73] Assignee: Touhaku Co., Ltd., Tottori, Japan

[21] Appl. No.: 598,000

[22] Filed: Oct. 12, 1990

[51] Int. Cl.[5] ..... A41H 43/00; B25B 11/00

[52] U.S. Cl. ..... 414/676; 112/121.12; 335/285; 269/54.5

[58] Field of Search ..... 414/676, 353; 83/29; 269/8, 20, 21, 54.1, 54.4, 54.5; 112/121.29, 121.11, 121.12, DIG. 2; 294/65.5; 335/285

[56] References Cited

U.S. PATENT DOCUMENTS

| | | | |
|---|---|---|---|
| 3,010,054 | 11/1961 | Goudsmit | 269/8 |
| 3,022,994 | 2/1962 | Eklund | 269/8 |
| 3,166,771 | 1/1965 | Kline et al. | 269/8 |
| 3,488,615 | 1/1970 | Yando | 335/285 |
| 3,837,084 | 9/1974 | Johnson | 269/8 |
| 3,949,629 | 4/1976 | Johnson | 335/285 X |
| 4,209,165 | 6/1980 | Hachisuka | 269/54.5 |
| 4,467,388 | 8/1984 | Thoe | 335/289 X |
| 4,468,648 | 8/1984 | Uchikune | 335/285 X |
| 4,652,845 | 5/1987 | Finkle | 335/285 |
| 4,679,021 | 7/1987 | Braillon | 335/285 X |
| 4,684,112 | 8/1987 | Chernikov et al. | 269/8 |
| 4,686,916 | 8/1987 | Mathias | 112/121.12 |
| 4,747,329 | 5/1988 | Lukens | 414/676 X |
| 4,822,015 | 4/1989 | Glasman et al. | 269/54.1 |
| 4,832,323 | 5/1989 | Principe et al. | 269/54.4 X |

FOREIGN PATENT DOCUMENTS

| | | | |
|---|---|---|---|
| 2062707 | 5/1981 | United Kingdom | 112/DIG. 2 |

*Primary Examiner*—Frank E. Werner
*Assistant Examiner*—Brian K. Dinicola
*Attorney, Agent, or Firm*—Spencer & Frank

[57] ABSTRACT

A work table on which sheets of patterned cloth are laid for the purpose of matching the patterns includes one or more electromagnets activatable to magnetize an upper surface of the table. Several pins which have magnetizable seats lie at spaced apart locations on the upper surface of the table so that when the electromagnet or electromagnets are activated, the pins are fixed magnetically on the upper surface of the table. When the electromagnet or electromagnets are deactivated, the pins are freely movable across the upper surface of the table. Thus, the cloth sheets can have their patterns aligned while the pins are fixed due to their magnetization, and are freely removed together with the pins when the pattern matching is completed and the electromagnet or electromagnets is switched OFF.

6 Claims, 6 Drawing Sheets

WORK TABLE FOR PATTERN MATCHING

FIELD OF APPLICATION

The present invention relates to an improvement of a work table for pattern matching which is used when plural sheets of cloth with a pattern are piled and cut simultaneously to be sewn as clothes with the pattern on each sheet matching with the pattern on other sheets of cloth.

PRIOR ART

A prior art pattern matching table includes a table for receiving a cloth material provided with plural through holes, a means for vertically reciprocating needles attached to piston rods through said through holes by the action of a fluid cylinder, a cylindrical operating unit which contains the needles therein and which is provided beneath said through holes in a freely reciprocating manner, a means for operating said reciprocating means stepwise via a timer relay and an electromagnetic valve by actuating a micro-switch by lowering said cylindrical operating unit, and a projector means which is movably provided above said work table for the cloth material and which indicates the position of the needles and pattern matching by projection (Jap. Pat Publication No. Sho 61-35306).

According to another example of the prior art, a base is interposed between two layers of thin material placed on a work table, and needles are arranged on the base in accordance with the pattern of the cloth material. Plural sheets of the cloth material are piled on the work table as guided by the needles. When the pattern is matched, the cloth is moved together with the thin layers and the base for cutting (Jap. Pat. Appln. Laid-open No. Sho 62-276074).

The work table according to Jap. Pat. Pub. No. Sho 61-35306 is advantageous in that the needles are firmly fixed on the table when the pattern is matched. On the other hand, when plural sheets of cloth are transferred to a cutting table after the pattern matching, the pattern may inconveniently become unmatched as the needles are pulled out.

In the case of laid-open Application No. Sho 62-276074, although the piled sheets of cloth material can be easily transported with the pattern held matched by the needles, needles may become displaced during the actual operation of pattern matching as the needles are merely interposed between the thin materials, and pattern matching tends to become inaccurate.

SUMMARY OF THE INVENTION

The present invention was contrived in view of the foregoing situations in the prior art, and aims at providing a work table for pattern matching which enables the needles to be firmly held in place during the pattern matching, and which prevents the cloth material from becoming displaced when transported to another table after the pattern matching.

Another object of the present invention is to provide a work table for pattern matching which enables smooth transportation of the cloth material after pattern matching.

The above objects of the present invention can be achieved by a work table which comprises electromagnets arranged on the work table at arbitrary positions, and plural pins each comprising a seat made of ferromagnetic material placed on the work table and a needle standing erect on the seat, and which is characterized in that said electromagnets are switched magnetically ON/OFF for pattern matching by means of switches.

Air vents are provided on the work table at a predetermined interval and compressed air is introduced into the vents from an air supply means to facilitate transportation of the cloth after the pattern is matched.

According to the present invention, the pins having needles are placed on the work table according to the pattern of the cloth material and then the electromagnets are magnetically switched ON to firmly hold the pins on the table.

Plural sheets of cloth are piled on top of another as guided by the marking needles of the pins fixed on the table for pattern matching. When the pattern matching is completed, the switch is turned OFF to demagnetize the electromagnets and to release the pins from fixation.

After the pins are released, the cloth is transported together with the pins to a place designated for cutting.

By injecting compressed air through the air vents provided on the work table, coefficient of the friction between the cloth and the work table is decreased and transportation of the cloth is facilitated.

BRIEF DESCRIPTION OF THE DRAWINGS

FIGS. 1 through 5 show a first embodiment of a work table according to the present invention; in which FIG. 1 is a perspective view of the work table FIG. 2 a front sectional view of the work table with portions of the work table being omitted, FIG. 3 a perspective view of a pin, FIG. 4 a time chart to show how the electric current is supplied to the control unit, and FIG. 5 a flow chart to show the pattern matching operation on the work table.

FIG. 6 is a perspective view of the work table, FIG. 7 a cross sectional view of the work table along the line VII—VII of FIG. 6, and FIG. 8 a cross-sectional view of the work table along the line VIII—VIII of FIG. 6.

DETAILED DESCRIPTION OF THE PREFERRED EMBODIMENTS

The present invention will now be described in more detail referring to the preferred embodiments shown in the attached drawings.

Figure 1:
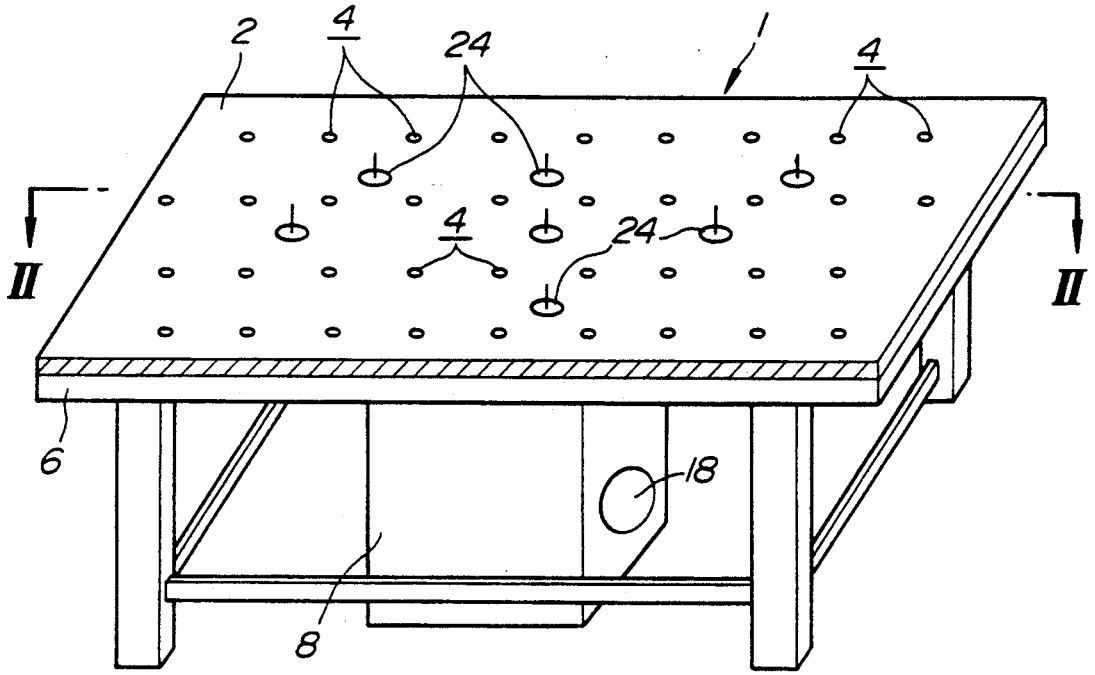
Figure 2:
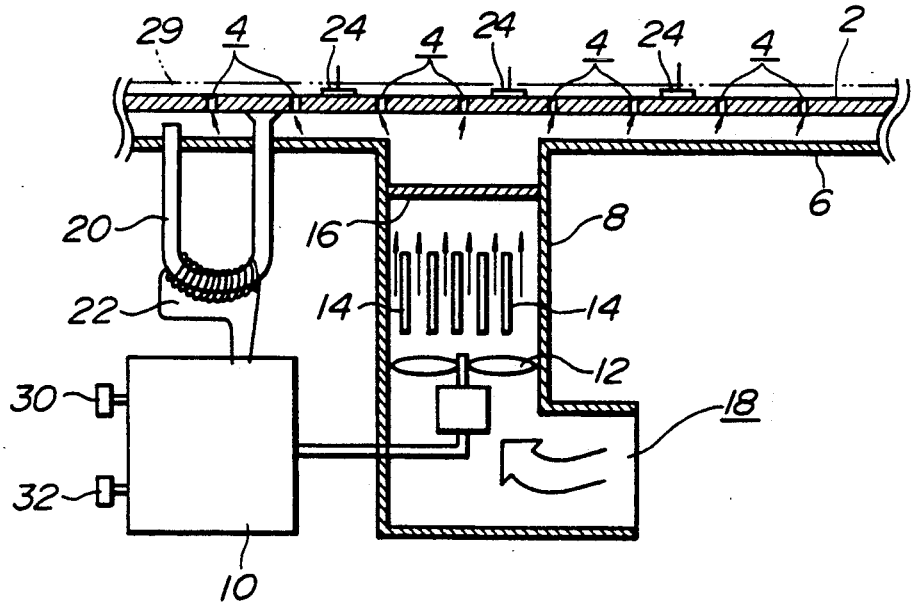
Figure 3:
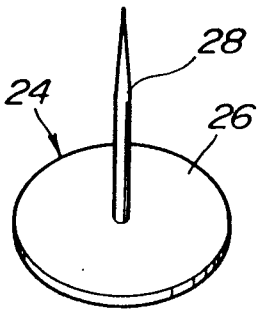

In the figures, the reference numeral 1 denotes a work table according to the present invention, on which a surface board 2 made of magnetic material is mounted Plural air vents 4 open through on the surface board 2 at a regular interval in a grid formation. The lower portion of the surface board 2 is covered by a casing 6 as shown in FIG. 2, and the casing 6 communicates with a duct 8.

Inside the duct 8 are disposed a fan 12 which is actuated, when supplied with electric power from a control unit 10, for feeding the air, plural partitions 14 which gives direction to the air feed to provide a uniform air supply, and a mesh 16 provided above said partitions 14 which enables the air supply to be still more uniform. Said fan 12 introduces air from an air intake port 18 in the duct and injects the air through the vents 4 to above the surface board.

The surface board 2 is connected with one end of a U-shaped ferromagnetic core 20 substantially at the center of the board, and an insulated conductor 22 such as a coil is wound about the core 20.

The insulated conductor 22 is connected to the control unit 10, and a plate electromagnet is formed by the control unit 10, the core 20, the insulated conductor 22 and the electromagnetized surface board 2.

The amount of current to be applied to the coil may differ depending on the number of coil windings, but is determined by the desired attractive force of the electromagnet.

The reference numeral 24 denotes a pin which is to be placed on the surface board 2 constituting the top of the work table 1. Each pin 24 comprises a disk-like seat 26 having a flat bottom surface and a needle 28 vertically bonded on the seat 26.

The seat 26 is preferably made of magnetizable material such as iron so that it can be attracted to the flat upper surface board 2 by the effect of the magnetic field. The needle is preferably such that it can penetrate the cloth 29 but will not leave a large hole in the cloth 29.

The thickness of the needle is preferably in the range of from 0.5 to 1.5 mm, and its length in the range of from 3 to 10 cm.

The control unit 10 supplies electric power to the fan 12 and the electromagnet, as shown in FIG. 2, and is switched ON/OFF by switches 30 and 32 provided on the unit 10.

Figure 4:
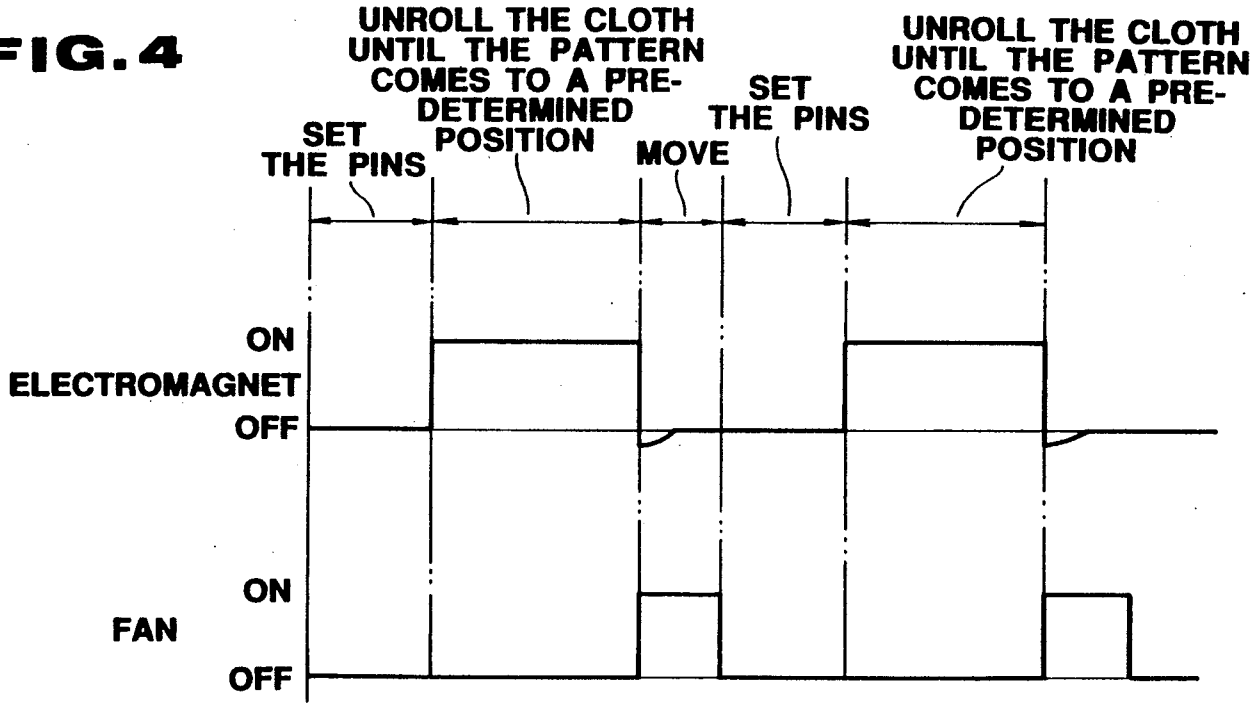

As shown in FIG. 4, the present invention is so constructed that a small amount of current is supplied in the reverse direction for a predetermined period of time after the power supply is suspended upon magnetization of the plate magnet in order to avoid residual magnetism from being briefly left on the surface board 2. This is to prevent residual magnetism from being generated on the surface board 2 when the cloth is transported since the seat 24 can be easily attracted to the board 2 by a trace magnetism.

Figure 5:
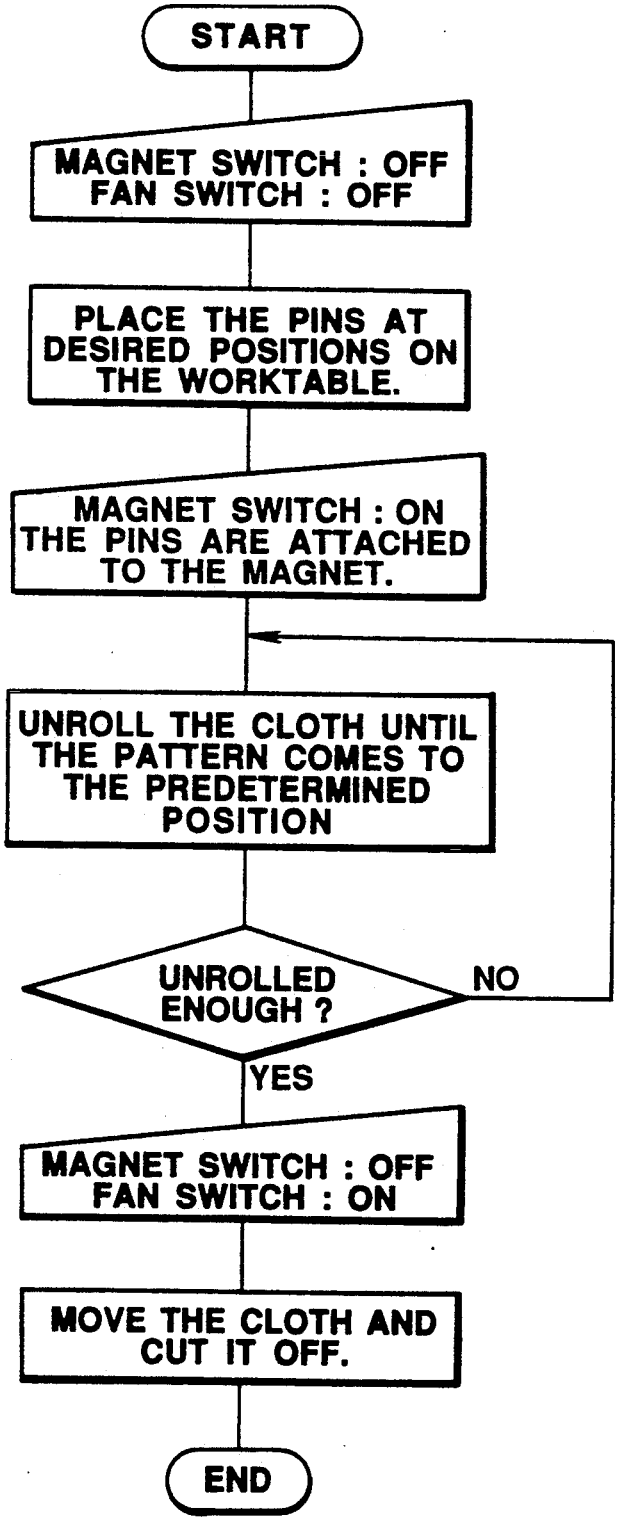

Referring now to the flow chart shown in FIG. 5, a plural number of seats 24 are placed on the work table 1 in accordance with the pattern of the cloth while the switch 30 for the magnet and the switch 32 for the fan are turned off.

When the seats 24 are in place, the switch 30 for the magnet is turned ON to cause the seats 24 to be attracted to and firmly fixed on the surface board 2.

As the seats 24 are fixed, the cloth is unrolled while registering the pattern with the needles 28 and piled in plural layers. When the pattern is matched, the switch 30 for the magnet is turned OFF to demagnetize the magnets, and the fan switch 32 is subsequently turned ON.

Air is drawn from the intake port 18 by the action of the fan 12, and the air, regulated in pressure by the partitions 14 and the mesh 16, is guided toward the bottom of the surface board 2 via the duct 8 and the casing 6. Air is then ejected against the cloth via the air vents 4 perforating on the surface board 2. As a result, the friction coefficient between the surface board 2 and the cloth 29 is decreased, and the cloth 29 can be easily slid on the table to be transported since the pins are now freely movable along the upper surface of the board 2.

Figure 6:
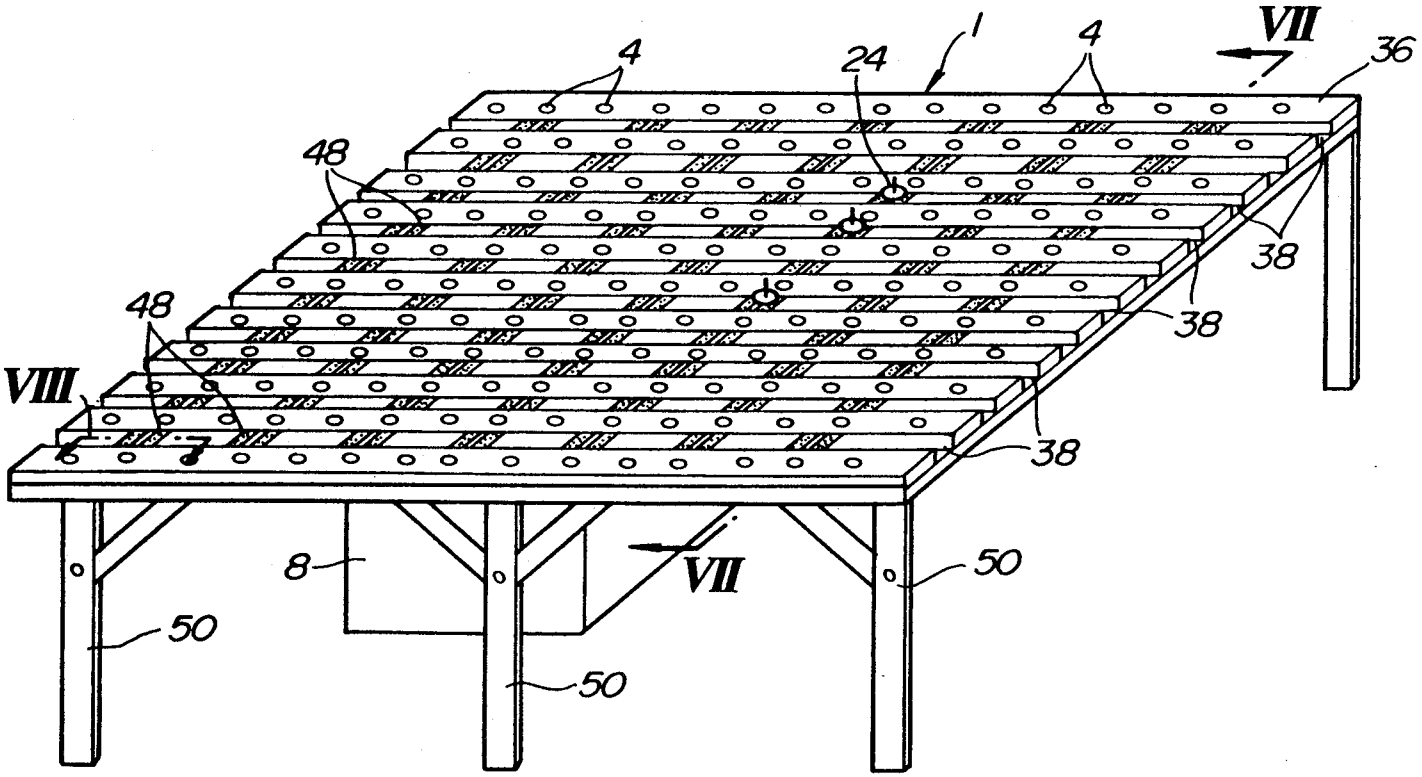
FIGS. 6 through 8 show the second embodiment of the work table according to the present invention.
Figure 7:
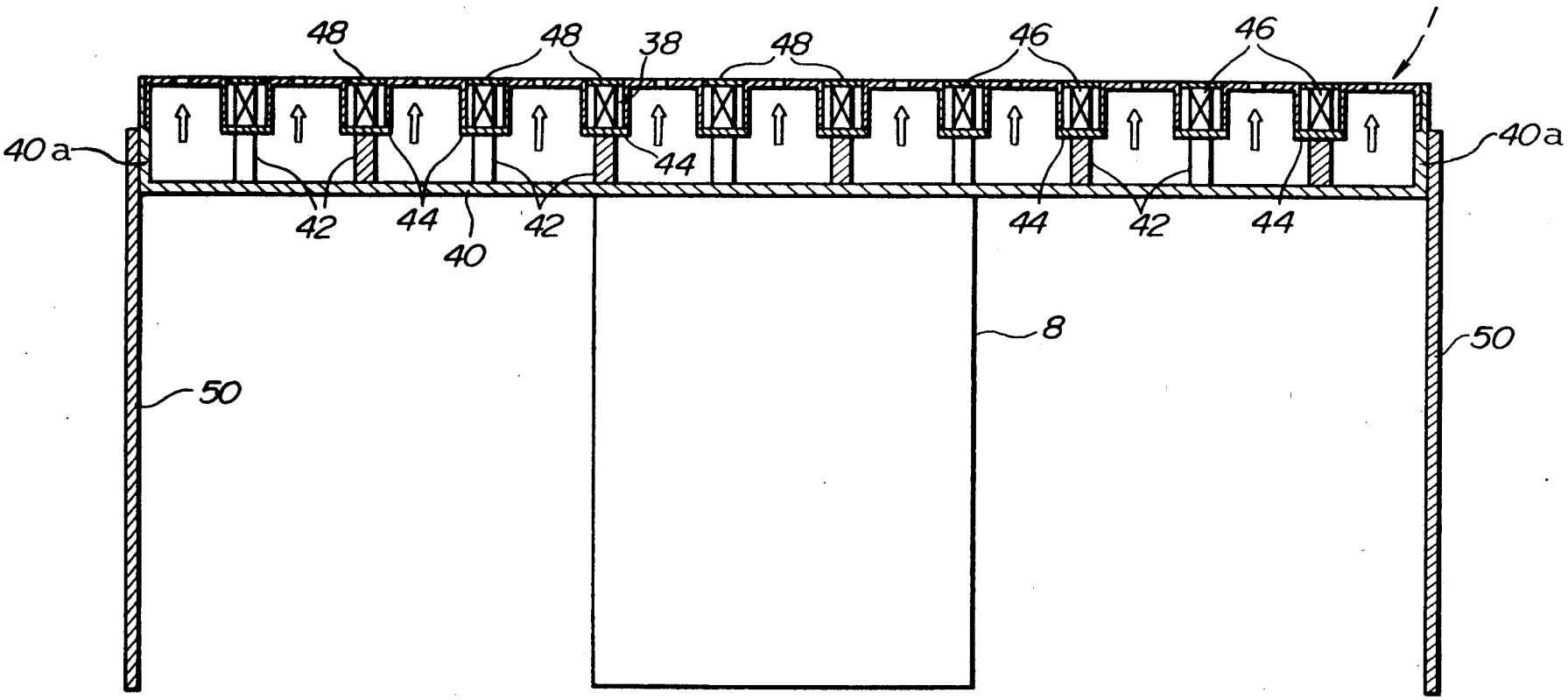
Figure 8:
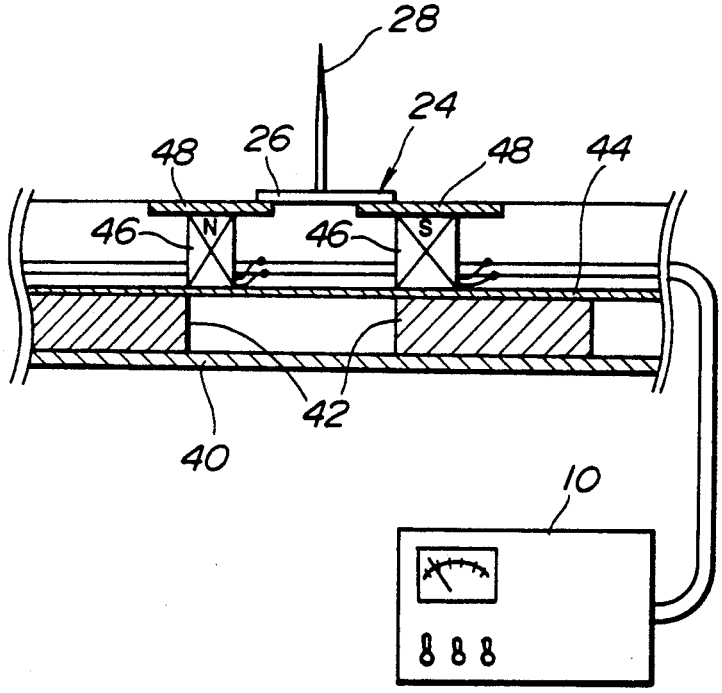

Referring now to FIGS. 6 through 8 which show a second embodiment of the present invention, the work table 1 comprises aluminum frame members 36, each having an inserted U-shape section, that are disposed in a parallel arrangement at uniform intervals to provide grooves 38 for receiving electromagnets. For example as shown in FIG. 7, plate members 42 are bonded on a rectangular frame member 40 at given intervals, and base plates 44 are disposed on the plate members 42. A respective U-shaped aluminum frame member 36 is suspended between each adjacent pair of the base plates 44, and the spaces between the frame members 36 are utilized as grooves 38 for receiving electromagnets 46. Air vents 4 are provided in each aluminum frame member 36 at predetermined uniform intervals along its length and air is injected into the air vents 4 under a uniform pressure from the fan 12, as in the case of the first embodiment.

Pairs of electromagnets 46 are arranged in each groove 38 at predetermined intervals along the lengths of the groove longitudinal as shown in FIG. 8, and a metal plate 48 made of ferromagnetic material is attached to the magnetic pole of each electromagnet 46. The distance between each metal plate 48 is approximately equal to ½ of the diameter of the seat 26 of the pin 24. Each electromagnet 46 is wired in parallel connection with the control unit 10 which supplies the power. It is noted that the plate members 42 located on both sides of the work table are associated with one of side plates **40*a* which constitutes the frame member 40, respectively. Legs 50 are attached to the side plates 40*a***.

With the work table having the above described construction, air is injected against the cloth via the vents 4 provided in the aluminum frame members 36, but not from the grooves 38 where the electromagnets 46 are disposed.

According to this second embodiment, the cloth is first placed on the work table 1, and the needles 28 are driven into the cloth at positions suitable for pattern matching. The seats 24 are then placed on the metal plate 48 before the switch on the control unit 10 for magnetization is turned ON to magnetically fix the seats on the metal plate 48. Another sheet of cloth is laid over the first sheet while matching the pattern as guided by the needles 28 on the seats 24. When a predetermined number of sheets of cloth are overlaid in a pile, the electromagnets 46 are demagnetized (by turning the switch for magnetization OFF) and the switch for demagnetization is turned ON. The fan 12 is also switched ON to reduce the friction coefficient between the cloth and the work table. This enables an operator to easily transport the piles of cloth carrying the pins therewith and to cut the cloth with the pattern kept matched.

Although electromagnets are placed on the entire in grooves for receiving the electromagnets in the embodiments illustrated in FIGS. 6–8, the present invention is in no way limited by such construction. It is possible to use non-magnetic material such as wood for the surface board and the control units may be disposed on the surface board in a grid, straight line or in any other arbitrary arrangement so that electromagnets, that can be magnetized/demagnetized by turning switches ON/-OFF, can be embedded.

FIELD OF INDUSTRIAL APPLICATION

As has been described in the foregoing, the work table for pattern matching according to the present invention can hold the needles which keep the pattern matched firmly in place during the pattern matching operation by the magnetizing action of the electromagnets and the needles may be released from the work table by demagnetizing the electromagnet or electromagnets after the matching operation, so that the pattern matching operation is facilitated and the cloth can be transported to another place for cutting while carrying the pins which keep the pattern matched.

What is claimed is:

1. A work table, comprising:

A top having an upper surface;

an electromagnetic means, activatable to magnetize at least a plurality of areas of said upper surface;

a plurality of pins, each pin including a seat lying on a respective magnetizable area of said upper surface and a needle fixed to said seat and projecting away from said upper surface, the seat being formed of a magnetic material, the pin being magnetically fixed to the respective magnetizable area when the area is magnetized and being freely movable across said upper surface when the magnetizable areas are demagnetized; and means for activating and deactivating said electromagnetic means, thereby to respectively magnetize and demagnetize said at least a plurality of areas of said upper surface.

2. A work table according to claim 1, wherein said upper surface and a bottom surface of each seat are flat.

3. A work table according to claim 1, wherein said top is formed of a magnetic material and said electromagnetic means comprises an electromagnet magnetically coupled to said top.

4. A work table according to claim 1, wherein said seats are disc-shaped.

5. A work table according to claim 1, wherein said top has uniformly spaced apart air vents formed therein, said work table further comprising means for blowing air at uniform pressure through said air vents to above said upper surface.

6. A work table according to claim 1, wherein said means for activating comprises an ON/OFF switch.

* * * * *